US005945270A

United States Patent [19]

Lok et al.

[11] Patent Number: 5,945,270

[45] Date of Patent: Aug. 31, 1999

[54] PHOTOGRAPHIC ELEMENT CONTAINING WATER SOLUBLE BIS AU(I) COMPLEXES

[75] Inventors: Roger Lok, Rochester; Weimar W. White, Canaseraga; Brian P. Cleary, Webster, all of N.Y.

[73] Assignee: Eastman Kodak Company, Rochester, N.Y.

[21] Appl. No.: 08/965,507

[22] Filed: Nov. 6, 1997

[51] Int. Cl.[6] ..... G03C 1/06

[52] U.S. Cl. ..... 430/605

[58] Field of Search ..... 430/605

[56] References Cited

U.S. PATENT DOCUMENTS

| | | | |
|---|---|---|---|
| 3,503,749 | 3/1970 | Tavernier et al. | 96/107 |
| 4,840,871 | 6/1989 | Peters et al. | 430/203 |
| 5,049,484 | 9/1991 | Deaton | 430/605 |
| 5,220,030 | 6/1993 | Deaton | 548/105 |
| 5,252,455 | 10/1993 | Deaton | 430/605 |
| 5,391,727 | 2/1995 | Deaton | 540/1 |
| 5,620,841 | 4/1997 | Lok et al. | 430/600 |

OTHER PUBLICATIONS

Japanese Abstract No. 8069075 A, Derwent Info. Ltd.

*Primary Examiner*—Johann Richter
*Assistant Examiner*—Joseph Murray
*Attorney, Agent, or Firm*—Sarah Meeks Roberts

[57] ABSTRACT

This invention relates to a silver halide photographic element comprising a support and a silver halide emulsion layer, the emulsion layer comprising an organomercapto Au(I) complex having the formula $$[(M—SOL)_n—A—S—Au—S—A—(SOL—M)_n]M$$

wherein M is a cationic counterion;

SOL is a solubilizing group:

A is a substituted or unsubstituted divalent organic linking group;

and n is 1 to 4 and wherein the compound is symmetrical.

It further relates to a method of preparing a silver halide emulsion utilizing said organomercapto Au(I) complexes.

43 Claims, No Drawings

PHOTOGRAPHIC ELEMENT CONTAINING WATER SOLUBLE BIS AU(I) COMPLEXES

CROSS REFERENCE TO RELATED APPLICATIONS

This application relates to commonly assigned copending application Ser. No. 08/964104, Express Mail No. EM031051546US, filed simultaneously herewith and hereby incorporated by reference for all that it discloses.

FIELD OF THE INVENTION

This invention relates to a photographic element containing an organomercapto Au(I) complex. It further relates to a method of sensitizing silver halide emulsions with such organomercapto Au(I) complexes.

BACKGROUND OF THE INVENTION

There has been considerable effort devoted to improving the sensitivity of silver halide crystals to actinic radiation and thereby increasing the sensitivity of the photographic elements in which they are contained. In this regard, photographic chemists have attempted to vary the components of, or the processes for making, silver halide emulsions. One particularly preferred means to improve sensitivity has been to chemically sensitize photographic emulsions with one or more compounds containing labile atoms of gold, sulfur, selenium or the like. Examples of chemically sensitized photographic silver halide emulsion layers are described in, for example, *Research Disclosure*, Item No. 308119, Dec. 1989, Section III, and the references listed therein. (*Research Disclosure* is published by Kenneth Mason Publications Ltd, Dudley Annex, 12a North Street, Emsworth, Hampshire PO 10 7DQ, England.)

Many gold sensitizers have been described. For example, U.S. Pat No. 3,503,749 describes the use of water soluble Au(I) thiolate salts comprising one Au atom ligated to one sulfur containing ligand; U.S. Pat. No. 5,220,030 teaches the use of Au(I) compounds with bis mesoionic heterocycles; U.S. Pat. No. 5,252,455 and U.S. Pat. No. 5,391,727 disclose the use of Au(I) macrocyclic cationic sensitizers; U.S. Pat. No. 5,049,484 teaches the use of Au(I) sensitizers having a Au atom ligated to the nitrogen atom of heterocyclic rings. U.S. Pat. No. 5,620,841 discloses the use of gelatin dispersions of a Au(I) thiosulfonato sensitizer with two different ligands at least one of which is mesoionic; and U.S. Ser. No. 8,672,254 teaches the use of gelatin dispersions of Au(I) thiosulfonato sensitizers with two different ligands at least one of which is a thioether group. JP 8069075 discusses the use of organic gold sulfide compounds in the sensitization to give low fogging and high contrast silver halide photographic materials. However, all of the above compounds have one or more disadvantages such as lack of water solubility, difficulty of synthesis or poor stability.

One common chemical sensitizer used in the sensitization of silver halide emulsions is aurous sulfide which is made as a colloidal gelatin dispersion, the exact composition of which is not well characterized. This gold sulfide dispersion can give rise to lot-to-lot variability and undesirable and inconsistent sensitometric performance. The source of this variability may come from side reactions in the preparation of this highly insoluble solid since these reactions produce species which may be photographically active. Further, because of the highly insoluble nature of gold sulfide, most of the sensitizer added is in fact unused during the sensitization. The remaining sensitizer left in the gel/silver halide matrix can affect sensitometry.

The bis Au(I) mesoionic heterocycles e.g. bis(l,4,5-trimethyl-1,2,4-triazolium-3-thiolate) gold (I) tetrafluoroborate, TTT, while being very useful sensitizers, are somewhat lacking in solution stability. Further, for the mesoionic triazolium sensitizers, multiple steps and recrystallizations are required in the preparation of the starting material bis(tetramethylthiourea) Au(I) tetrafluoroborate. Synthesis of the gold ligand 1,4,5-trimethyl-1,2,4-triazolium-3-thiolate is difficult, and the preparation of the mesoionic triazolium sensitizer is limited to small batches. Finally, the limited solubility of the mesoionic triazolium sensitizers requires the use of a large volume of water for dissolution.

Thus, there is still need for effective Au (I) compounds that are stable, water soluble and well characterized. Further, they must be easily manufactured from readily available starting materials.

SUMMARY OF THE INVENTION

This invention relates to a photographic element comprising a support and a silver halide emulsion layer, the emulsion layer comprising a water soluble Au(I) complex having the formula $$[L—Au—L]M$$

wherein the complex is symmetrical; L is an organomercapto ligand which has antifogging, stabilizing or sensitizing properties, and M is a cationic counter ion. This invention further relates to a silver halide photographic element comprising a support and a silver halide emulsion layer, the emulsion layer comprising an organomercapto Au(I) complex having the formula $$[(M—SOL)_n—A—S—Au—S—A—(SOL—M)_n]M$$

wherein M is a cationic counterion;

SOL is a solubilizing group:

A is a substituted or unsubstituted divalent organic linking group;

and n is 1 to 4 and wherein the compound is symmetrical.

This invention also provides a silver halide photographic element comprising a support and a silver halide emulsion layer, the emulsion layer having been chemically sensitized in the presence of an organomercapto Au(I) complex having the above formula.

It further provides a method of preparing a silver halide emulsion comprising precipitating silver halide grains in an aqueous colloidal medium to form an emulsion, heating the emulsion, and adding to the emulsion, either before or during heating, an organomercapto Au(I) complex of the above formula.

The novel organomercapto Au(I) complexes contained in the photographic elements of this invention have numerous advantages. They are highly effective sensitizers for silver halide emulsions. They are also highly water soluble. Because of the water solubility of these complexes, the use of costly and time consuming preparation of gel dispersions is unnecessary. Further, there is no need to use large volumes of water for dissolving the complexes.

Unlike prior mixed-ligand gold compounds, the two Au ligands in the complexes of this invention are identical, thus reducing the complexity of preparation. Further, the complexes utilize inexpensive and commercially available starting materials. Another advantage is that the preparation of the gold complexes of the present invention does not utilize dangerous explosive gold fulminates or large quantities of organic solvents.

Additionally, because of the stability of the covalent gold and sulfur bonds, the complexes of the present invention are more stable than those having mesoionic ligands. Indeed, there is evidence that even in acidic solutions, the complexes of the present invention are more stable than those of the mesoionic sensitizers.

The organomercaptides used in the preparation of the Au(I) complexes may include the numerous thiolic antifoggants/stabilizers. Because of the sensitizing, antifogging, and stabilizing properties of these thiolic ligands, the Au(I) sensitizers derived from these ligands may also show speed enhancing and antifogging/stabilizing effects in addition to their sensitizing properties

DETAILED DESCRIPTION OF THE INVENTION

The water soluble organomercapto Au(I) complexes of this invention may be represented by the formula

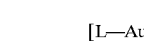

[L—Au—L]M wherein the complex is symmetrical. L is an organomercapto ligand which has antifogging, stabilizing or sensitizing properties and which is suitable for use in a silver halide photographic element. Many such ligands are known in the art and are either commercially available or may be prepared as described in Research Disclosure 274 (1984). Some suitable ligands include thiolic ligands having hydrophilic substituents such as mercaptoazoles, examples of which are contained in U.S. Pat,. Nos. 3,266,897; 4,607,004; 3,266,897; 4,920,043; 4,912,026; 5,011,768 and U.K. Patent 1,275,701. M is a cationic counter ion.

The organomercapto Au(I) complexes of the invention may be further represented by the formula

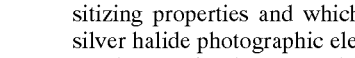

$[(M—SOL)_n—A—S—Au—S—A—(SOL—M)_n]M$ with the complex being symmetrical. M is a cationic counterion. Preferably M is an alkali metal, for example potassium, sodium or cesium, or an ammonium cation, for example, a tetrabutyl or tetraethyl ammonium group. SOL is a water solubilizing group, suitable examples of which are sulfato, sulfonato, sulfinato, phosphato, and carboxy groups n is an integer from 1 to 4, and more preferably n is 1 or 2.

A is a substituted or unsubstituted divalent organic radical. Preferably A is an aliphatic, (cyclic or acyclic), aromatic or heterocyclic divalent group. When A is an aliphatic group, preferably it is a substituted or unsubstituted alphatic group having 1 to 20 carbon atoms, and more preferably having 1 to 8 carbon atoms. Examples of appropriate groups include alkylene groups such as ethylene, methylene, propylene, butylene, pentylene, hexylene, octylene, 2-ethylhexylene, decylene, dodecylene, hexadecylene, octadecylene, cyclohexylene, isopropylene and t-butylene groups.

The preferred aromatic groups have from 6 to 20 carbon atoms. More preferably, the aromatic groups have 6 to 10 carbon atoms and include, among others, phenylene and naphthylene groups. These groups may have substituent groups. The heterocyclic groups are preferably substituted or unsubstituted divalent 3 to 15-membered rings with at least one atom selected from nitrogen, oxygen, sulfur, selenium and tellurium in the ring nucleus. More preferably, the heterocyclic groups are 5 to 6-membered rings with at least one atom, and preferably more than one atom, selected from nitrogen. Examples of heterocyclic groups include the divalent radicals of pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings. The preferred heterocyclic group is tetrazole.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be bonded to the remainder of the molecule by an atom of carbon, silicon, oxygen, nitrogen, phosphorous, or sulfur. Suitable substituents for A include, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamnido, p-dodecylbenzenesulfonamido, N-methyltetradecylsulfonarnido, N,N-dipropylsulfamoylamnino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy. One particularly suitable substituent for A is a benzamido group.

Generally, the above groups and substituents thereof may include those having up to 48 carbon atoms, typically 1 to 36 carbon atoms and usually less than 24 carbon atoms, but greater numbers are possible depending on the particular substituents selected.

When A is substituted, $(SOL—M)_n$ may be attached to the substituent. In one suitable embodiment A—(SOL—M), (wherein n is 1) is

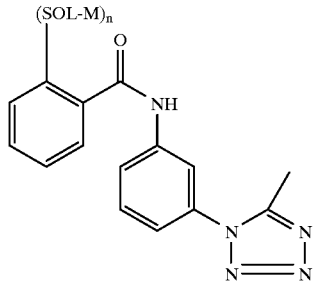

Specific examples of the Au(I) complexes include, but are not limited to $NaAu—(SCH_2CO_2Na)_2$ (A)

$NaAu—(SCH_2CH_2CHOMeCH_2OPO_3Na)_2$ (B)

$NaAu—(SCH_2CHOHCH_2SO_3Na)_2$ (C)

-continued $NaAu—(SCH_2CH_2SO_2Na)_2$ (D)

$KAu—(SCHMeCHClCH_2CH_2SO_3K)_2$ (E)

$CsAu—(SCH_2CHCNCH_2CH_2PO_3Cs)_2$ (F)

(G)

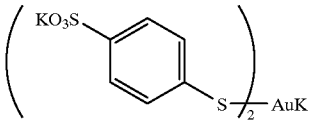

(H)

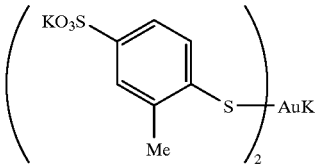

(I)

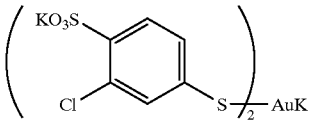

(J)

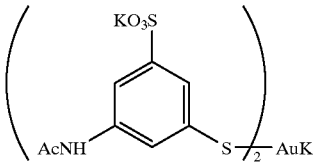

(K)

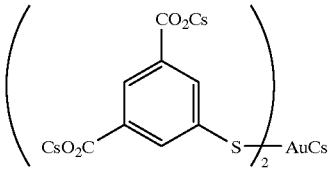

(L)

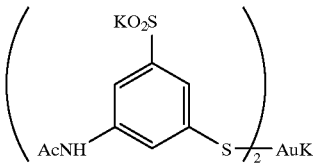

(M)

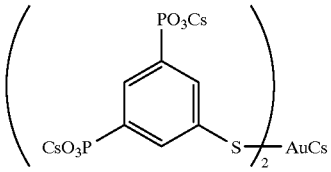

(N)

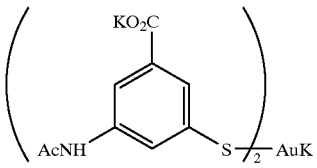

-continued (O)

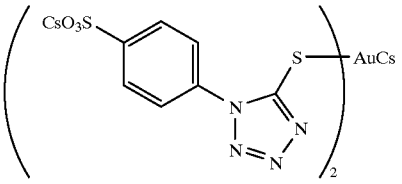

(P)

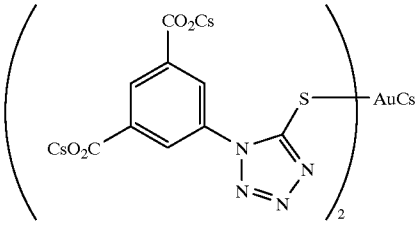

(Q)

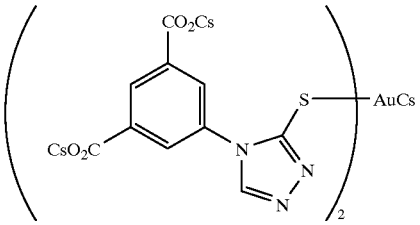

(R)

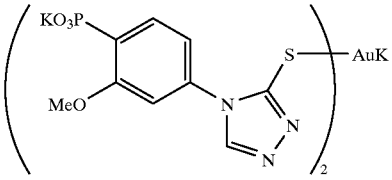

(S)

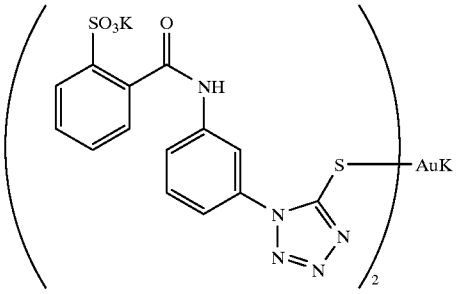

(T)

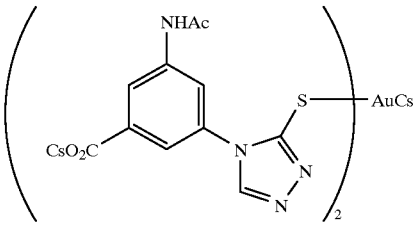

-continued (U)

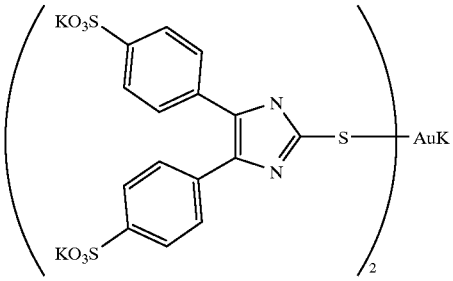

(V)

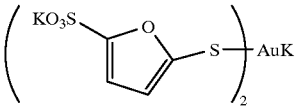

(X)

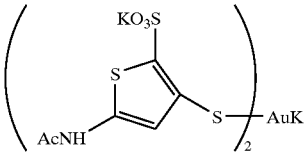

One particularly suitable complex is Compound S, potassium bis(1-[3-(2-sulfonatobenzamido)phenyl]-5-mercaptotetrazole potassium salt) aurate(I) pentahydrate.

One of the advantages of the complexes of this invention is their solubility in water. Preferably they have a solubility at 22° C. of 2 g/L, more preferably 5 g/L, and most preferably 10 g/L. Particularly suitable compounds have a solubility of greater than 20 g/L.

The organomercapto Au(I) complexes are manufactured by reacting an Au (I) complex with an organomercapto ligand and isolating the resulting organomercapto Au(I) complex from the reaction mixture. Suitable Au(I) complexes for use in this process are those having a more positive redox potential than the desired organomercapto Au(I) complex, thus allowing for the easy replacement of the ligand. Such compounds are known to those skilled in the art. Examples of some useful Au(I) complexes include $AuCl_2^-$, $AuBr_2^-$, $Au(MeS—CH_2—CH_2—CHNH_2COOH)_2^+$, $Au(C_3H_3N_2—CH_2—CH_2—NH_2)_2^+$, $Au(CNS)_2^-$, AuI, or $Au(NH_3)_2^+$, with AuI being particulary suitable.

Because the Au(I) complexes can be somewhat unstable, it is preferred to prepare them immediately before use by reacting a Au(III) compound with a stoichiometric amount of a reducing agent. The Au(III) compound can be any such compound which can be reduced to a stable Au(I) complex. Many of these compounds are commercially available. Examples of suitable compounds include $KAuBr_4$, $KAuCl_4$ and $HAuCl_4$. The reducing reagents may be, among others, tetrahydrothiophene, 2,2'-thiodiethanol, thiourea, N,N'-tetramethylthiourea, alkyl sulfides (eg. dimethylsulfide, diethylsulfide, diisopropylsulfide), thiomorpholin-3-one, sulfite, hydrogen sulfite, uridine, uracil, alkali hydrides and iodide. (Uson, R.; Laguna, A.; Laguna, M. *Inorg. Synth.* 1989, 26, 85–91; Al-Saady, A. K.; McAuliffe, C. A.; Parish, R. V.; Sandbank, J. A. *Inorg. Synth.* 1985,23, 191–194; Ericson, A.; Elding, L. I.; Elrnroth, S.K.C.; *J. Chem. Soc., Dalton Trans.* 1997, 7, 1159–1164; Elding, L. I.; Olsson, L. F. *Inorg. Chem.* 1982, 21, 779–784; Annibale, G.; Canovese, L.; Cattalini, L.; Natile, G. *J. Chem. Soc., Dalton Trans.* 1980, 7, 1017–1021). In some instances the reduction can be performed in the presence of a stabilizing agent such as potassium chloride (Miller, J. B.; Burmeister, J. L. *Synth. React Inorg. Met.-Org. Chem.* 1985, 15, 223–233. In some instances it may be desirable to isolate the resulting Au (I) compound, i.e. to avoid undesirable side reactions. For example, in the case of AuI, removal of excess iodine is desirable to avoid deleterious sensitometric effects. Depending on the stability of the resulting Au(I) compound, however, its isolation may not be practical.

It is preferable that the Au(I) complex/organomercapto reaction be done in an aqueous system, however, as shown in the examples, this is not imperative. In general, the procedure requires no more than the mixing or stirring of the reagents for a short time, preferably at a temperature slightly above room temperature. The Au(I) compound is treated with at least two equivalents of a water soluble organo mercapto ligand, preferably a water soluble salt of the ligand. Only one species of organomercapto ligand is utilized in the reaction in order to obtain a symmetrical mercapto Au(I) complex. Preferably the organomercaptide ligand has the formula $$(M—SOL)_n—A—S—M$$

wherein M, SOL, A and n are as defined earlier for the organomercapto Au(I) complex. One suitable organomercaptide ligand is 1-[3-(2-sulfonatobenzamido)phenyl]-5-mercaptotetrazole potassium salt.

The reaction may be done in a very broad temperature range, preferably ambient to 100°C., and more preferably 30 to 50° C. Generally, the reaction can take place in the natural pH of the system, and does not need adjustment. It is believed that a fairly neutral pH, of about 4 to 7.5 is preferable, with a pH of about 6 being most preferable. In most cases the reaction of the Au(I) complex and the organomercapto ligand takes place in just a few minutes at a temperature of 30° C., although this may differ depending on the reactants. It may be necessary to add a stabilizing electrolyte such as $Cl^-$ or $Br^-$ when utilizing particularly unstable Au(I) complexes.

Isolation of the resulting Au(I) product may be achieved by any suitable method, for example by the treatment of the reaction mixture with several equivalents of an alkali halide or by the addition of a water miscible non-solvent. The solid Au(I) complex may be collected by filtration and dried in vacuo. The perferred method of isolation typically involves the introduction of an alkali halide followed by cooling of the reaction solution. The material is isolated by suction filtration and treated with chilled aqueous alcohol washes, such as butanol, isopropanol, ethanol etc. The procedure is straight forward with no complicated operations or multiple recrystallizations.

The photographic emulsions of this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40 ° C. to 70 ° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The organomercapto Au(I) complexes may be added to the silver halide emulsion at any time during the preparation of the emulsion, i.e., during precipitation, during or before chemical sensitization or during final melting and co-mixing of the emulsion and additives for coating. Preferably, the emulsion is chemically sensitized in the presence of the organomercapto Au(I) complexes. More preferably, these compounds are added after precipitation of the grains, and most preferably they are added before or during the heat treatment of the chemical sensitization step.

The organomercapto Au(I) complexes may be introduced into the emulsion at the appropriate time by any of the various techniques known to those skilled in the art. Preferably they are added as an aqueous solution to the emulsion. One suitable method includes preparing a silver halide emulsion by precipitating silver halide grains in an aqueous colloidal medium to form an emulsion, digesting (heating) the emulsion, preferably at a temperature in the range of 40 to 80° C., and adding to the emulsion, either before or during heating, an aqueous solution of the organomercapto Au(I) complex. In one preferred embodiment the emulsion is also sensitized with thiosulfate pentahydrate (hypo).

Conditions for sensitizing silver halide grains such a pH, pAg, and temperature are not particularly limited. The pH is generally about 1 to 9, preferably about 3 to 6, and pAg is generally about 5 to 12, preferably from about 7 to 10.

The organomercapto Au(I) complexes may also be added to the vessel containing the aqueous gelatin salt solution before the start of the precipitation; or to a salt solution during precipitation. Other modes are also contemplated. Temperature, stirring, addition rates and other precipitation factors may be set within conventional ranges, by means known in the art, so as to obtain the desired physical characteristics.

The organomercapto Au(I) complexes may be used in addition to any conventional sensitizers as commonly practiced in the art. Combinations of more than one organomercapto Au(I) complex may be utilized.

Useful levels of Au(I) sensitizers of the present invention may range from 0.01 $\mu$mol to 10,000 $\mu$mol per silver mole. The preferred range is from 0.05 $\mu$mol to 1,000 $\mu$mol per silver mole. A more preferred range is from 0.1 $\mu$mol to 500 $\mu$mol per silver mole. The most preferred range is from 1 $\mu$mol to 50 $\mu$mol/Ag mole The silver halide emulsions utilized in this invention may be comprised of any halide distribution. Thus, they may be comprised of silver bromoiodide, silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. Preferably, the silver halide emulsions utilized in this invention are predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubooctahedrons, or any of the other naturally occurring morphologies of cubic lattice type silver halide grains. Further, the grains may be irregular such as spherical grains or tabular grains. Grains having a tabular or cubic morphology are preferred.

The photographic emulsions may be incorporated into color negative (particularly color paper) or reversal photographic elements. The photographic element may also comprise a transparent magnetic recording layer such as a layer containing magnetic particles on the underside of a transparent support, as described in *Research Disclosure*, Nov. 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in Research Disclosure, Jun. 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) *Research Disclosure*, Dec. 1978, Item 17643, (2) *Research Disclosure*, Dec. 1989, Item 308119, (3) *Research Disclosure*, Sep. 1994, Item 36544, and (4) *Research Disclosure*, Sep. 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure*, Feb. 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 & 4 | I, II, III, IX A & B | hardeners, coating aids, addenda, etc. |
| 1 | III, IV | Chemical sensitization and |
| 2 | III, IV | spectral sensitization/ |
| 3 & 4 | IV, V | desensitization |
| 1 | V | UV dyes, optical |
| 2 | V | brighteners, luminescent |
| 3 & 4 | VI | dyes |
| 1 | VI | Antifoggants and |

-continued

| Reference | Section | Subject Matter |
|---|---|---|
| 2 | VI | stabilizers |
| 3 & 4 | VII | |
| 1 | VIII | Absorbing and scattering |
| 2 | VIII, XIII, XVI | materials; Antistatic layers; matting agents |
| 3 & 4 | VIII, IX C & D | |
| 1 | VII | Image-couplers and image- |
| 2 | VII | modifying couplers; Wash- |
| 3 & 4 | X | out couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be incorporated into exposure structures intended for repeated use or exposure structures intended for limited use, variously referred to as a single use cameras, lens with film, or photosensitive material package units.

The photographic elements can be exposed with various forms of energy which encompass the ultraviolet, visible, and infrared regions of the electromagnetic spectrum as well as the electron beam, beta radiation, gamma radiation, X-ray, alpha particle, neutron radiation, and other forms of corpuscular and wave-like radiant energy in either noncoherent (random phase) forms or coherent (in phase) forms, as produced by lasers. When the photographic elements are intended to be exposed by X-rays, they can include features found in conventional radiographic elements.

The photographic elements are preferably exposed to actinic radiation, typically in the visible region of the spectrum, to form a latent image, and then processed to form a visible dye image. Development is typically followed by the conventional steps of bleaching, fixing, or bleach-fixing, to remove silver or silver halide, washing, and drying.

The following examples are intended to illustrate, but not limit, the invention.

EXAMPLES

Example 1

Preparation of Compound S·5 $H_2O$.

To a stirred, aqueous solution of $KAuCl_4$ (23.41 g in 172 mL water) was added 200 mL of a 4.22% (w/w) aqueous solution of NaI. The water was decanted from the dark brown solid which was washed three times with 116 mL of water. Additionally, the solid was washed with several 116 mL aliquots of absolute ethanol until no color was observed in the ethanol phase. The remaining yellow solid was washed once with 116 mL of water and then quickly added to a stirred solution of 70 g of 1-[3-(2-sulfonatobenzamido) phenyl]-5-mercaptotetrazole potassium salt in 750 mL of 30° C. water. The resulting solution was filtered and treated with 250 mL of 25% (w/w) aqueous KCl. Cooling to 5° C. yielded the product as a crystalline solid which was isolated by filtration, washed with 3×100 mL chilled (5° C.) aqueous isopropanol (60%), 2×100 mL chilled (5° C.) isopropanol (100%), dried in air by suction and then dried to 45° C. under $N_2$ to constant weight. The resulting material was equilibrated at 21° C. and 70% relative humidity to constant weight. Isolated yield was 65.3 g (91%). Compound S·5 $H_2O$ displays infrared, $^1H$ nuclear magnetic resonance and mass spectra that are consistent with materials possessing the molecular structures illustrated above. Elemental analyses were completed (theoretical values are shown parenthetically): C=29.2% (29.1 %), H=2.2% (2.4%), N=12.1% (12.2%), S=11.1% (11.5%), Au=17.2% (17.1%).

Example 2

Preparation of Compound O.

To a stirred, aqueous solution of $KAuCl_4$ (6.0 g in 50 mL water) was added 65 mL of a 4.22% (w/w) aqueous solution of NaI. The water was decanted from the dark brown solid and washed 3 times with 75 mL of water. Additionally, the solid was washed with several 75 mL aliquots of absolute ethanol until no color was observed in the ethanol phase. The remaining yellow solid was washed once with 75 mL of water and then quickly added to a warm (50° C.), stirred solution containing 21 g of 1 -(4-sulfonatophenyl)-5-mercaptotetrazole potassium salt that has been dissolved in 200 mL of water and neutralized with aqueous $CsOH{\cdot}H_2O$. An off white solid was obtained by filtration after the addition of 50 g of CsCl and cooling to 10° C. Crystallization from boiling water, and two successive washes of water and ethanol (2×150 mL, 0° C. and 2×150 mL, respectively) yielded the purified product. Compound O displays infrared, $^1H$ nuclear magnetic resonance and mass spectra that are consistent with materials possessing the molecular structures illustrated above. Elemental analyses were completed (theoretical values are shown parenthetically): C=15.8% (15.2%), H=1.2% (0.7%), N=10.6% (10.1%).

Example 3

Preparation of Compound P.

To a stirred, aqueous solution of $KAuCl_4$ (7.0 g in 50 mL water) was added 70 mL of a 4.22% (w/w) aqueous solution of NaI. The water was decanted from the dark brown solid and washed 3 times with 35 mL of water. Additionally, the solid was washed with several 35 mL aliquots of absolute ethanol until no color was observed in the ethanol phase. The remaining yellow solid was washed once with 35 mL of water and then quickly added to a warm (50° C.), stirred solution containing 11.05 g of 1-(3, 5-dicarboxyphenyl)-5-mercaptotetrazole diacid that has been dissolved in 320 mL of water and neutralized with aqueous $CsOH{\cdot}H_2O$. The addition of HCl led to the immediate precipitation of an off white solid. The solid was isolated, suspended in 200 mL of water and dissolved by the addition of an aqueous solution of $CsOH—H_2O$. Neutralization by the addition of HCl, followed by the addition of 2 L of absolute ethanol yielded the crude product. Purification was effected by recrystallization from an acetone and water solution. Compound P displays infrared, $^1H$ nuclear magnetic resonance and mass spectra that are consistent with materials possessing the molecular structures illustrated above. Elemental analyses were completed (theoretical values are shown parenthetically): C=16.3% (15.6%), H=1.2% (0.5%), N=8.2% (8.1%).

Example 4

In accordance with the present invention, a 0.3 mol of a negative silver chloride emulsion was sensitized with a green spectral sensitizing dye, 5-chloro-2-[2-[[5-phenyl-3-(3-sulfobutyl)-2(3H)-benzoxazolylidene]methyl]-1-butenyl]-3-(3-sulfopropyl)-benzoxazolium sodium salt (379.45 mg/Ag mol),), with or without 0.28 mg/Ag mol of sodium thiosulfate pentahydrate (hypo) as indicated in Table 1, the comparison sensitizer TTT, the mercaptan compound QQ, and compound S at levels indicated in Table 1 at 40° C. The emulsion was heated to 60° C. at a rate of 10° C. per 6 minutes and then held at this temperature for 40 minutes. The emulsion was cooled to 40° C. at a rate of 10° C. per 6 minutes. At 40° C., solutions of 1-(3-acetamidophenyl)-5-mercaptotetrazole (200 mg/Ag mol) and potassium bromide (795 mg/Ag mol) were added to the emulsion. This emulsion was mixed further with a green dye-forming coupler 7-chloro-6-(1, I-dimethylethyl)-3-[3-(dodecylsulfonyl) propyl]- 1 H-pyrazolo[5,1-c]-1,2,4-triazole (0.018 g/$m^2$) in di-n-butylphthalate coupler solvent and gelatin. The emulsion (0.102 g Ag/$m^2$) was coated on a resin coated paper support and an overcoat applied as a protective layer along with the hardener bis (vinylsulfonyl) methyl ether in an amount of 1.8% of the total gelatin weight.

The coatings were given a 0.1 second exposure, using a 0–3 step tablet (0.15 increments) with a tungsten lamp designed to stimulate a color negative print exposure source. This lamp had a color temperature of 3000 K, log lux 2.95, and the coatings were exposed through a combination of magenta and yellow filters, a 0.3 ND (Neutral Density), and a UV filter. The processing consisted of a color development (45 sec, 35° C.), bleach-fix (45 sec, 35° C.) and stabilization or water wash (90 sec, 35° C.) followed by drying (60 sec, 60° C.). The chemistry used in the Colenta processor consisted of the following solutions:

| | |
|---|---|
| Developer: | |
| Lithium salt of sulfonated polystyrene | 0.25 mL |
| Triethanolamine | 11.0 mL |
| N,N-diethylhydroxylamine (85% by wt.) | 6.0 mL |
| Potassium sulfite (45% by wt.) | 0.5 mL |
| Color developing agent (4-(N-ethyl-N-2-methanesulfonyl aminoethyl)-2-methyl-phenylenediaminesesquisulfate monohydrate | 5.0 g |
| Stilbene compound stain reducing agent | 2.3 g |
| Lithium sulfate | 2.7 g |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |
| Bleach-fix | |
| Ammonium sulfite | 58 g |
| Sodium thiosulfate | 8.7 g |
| Ethylenediaminetetracetic acid ferric ammonium salt | 40 g |
| Acetic acid | 9.0 mL |
| Water to total 1 liter, pH adjusted to 6.2 | |
| Stabilizer | |
| Sodium citrate | 1 g |
| Water to total 1 liter, pH adjusted to 7.2. | |

The speed taken at the 1.0 density point of the D log E curve is taken as a measure of the sensitivity of the emulsion. Dmin is measured as the minimum density above zero. Toe at 0.5 is taken as the density at 0.5 log E fast of the density point of 1.0. Toe at 0.3 is taken as the density at 0.3 log E fast of the density point of 1.0. Shoulder is taken as the density at 0.5 log E slow of the density point of 1.0.

TABLE 1

| Sample | Sensitizer | μmol / Ag mol | Hypo | Spd | Dmin | 0.5 Toe | 0.3 Toe | Shldr | Gamma | Dmax |
|---|---|---|---|---|---|---|---|---|---|---|
| 1 (comparison) | none | 0 | N | 89 | 0.094 | 0.268 | 0.450 | 1.488 | 1.730 | 1.623 |
| 2 (comparison) | none | 0 | Y | 89 | 0.098 | 0.278 | 0.456 | 1.977 | 2.535 | 2.655 |
| 3 (comparison) | TTT | 7 | N | 91 | 0.098 | 0.319 | 0.492 | 1.928 | 2.394 | 2.676 |
| 4 (comparison) | TTT | 7 | Y | 92 | 0.098 | 0.330 | 0.503 | 1.891 | 2.314 | 2.637 |
| 5 (comparison) | QQ | 14 | Y | 92 | 0.095 | 0.324 | 0.501 | 1.890 | 2.315 | 2.633 |
| 6 (invention) | S | 1.75 | Y | 155 | 0.101 | 0.268 | 0.499 | 1.429 | 1.549 | 2.696 |
| 7 (invention) | S | 3.5 | Y | 175 | 0.102 | 0.163 | 0.321 | 2.059 | 2.896 | 2.724 |
| 8 (invention) | S | 5.25 | Y | 175 | 0.097 | 0.166 | 0.335 | 2.056 | 2.868 | 2.711 |
| 9 (invention) | S | 7 | Y | 177 | 0.097 | 0.172 | 0.339 | 2.061 | 2.871 | 2.722 |
| 10 (invention) | S | 8.75 | Y | 176 | 0.099 | 0.176 | 0.346 | 2.028 | 2.805 | 2.698 |
| 11 (invention) | S | 10.5 | Y | 177 | 0.099 | 0.180 | 0.349 | 1.910 | 2.601 | 2.697 |
| 12 (invention) | S | 12.25 | Y | 175 | 0.099 | 0.187 | 0.365 | 1.939 | 2.624 | 2.669 |
| 13 (invention) | S | 14 | Y | 173 | 0.101 | 0.200 | 0.388 | 1.893 | 2.507 | 2.694 |

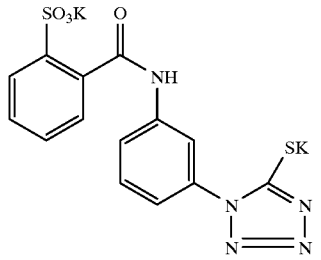

QQ

Gamma is the slope of the line between the density points that are 0.3 log E faster and 0.3 log E slower than the density point at 1.0. Dmax is the maximum density of the D log E curve.

It can be seen in Table 1 that samples 1 (without a sensitizer and without hypo), 2 (without sensitizer but with hypo), 3, 4 (both with TTT but with or without hypo), and 5 (with only the ligand and hypo but no Au) all have lower speed than samples of the present invention (6–13) which contain compound S and hypo. More specifically, samples 9, 10 and 11 have the best combination of speed, Dmin, toes (lower values indicate sharper toe), high shoulder and contrast.

Example 5

In another practice of the invention, a 0.3 mole cubic negative silver chloride emulsion was sensitized with p-glutaramidophenyl disulfide (10 mg/Ag mol) with or without hypo (7.42 mg/Ag mol), and gold sensitizers as indicated in Table 2 at 40° C. The emulsion was heated to 60° C. at a rate of 20° C. per 17 minutes and then held at this temperature for 52 minutes. During this time, 1-(3-acetamidophenyl)-5-mercaptotetrazole (297 mg/Ag mol), potassium hexachloroiridate (0.121 mg/Ag mol) and potassium bromide (1359 mg/Ag mol) were added. The emulsion was cooled down to 40° C. at a rate of 20° C. per 17 minutes. At this time, a red spectral sensitizing dye, anhydro-3-ethyl-9,11-neopentylene-3'-(3-sulfopropyl)thiadicarbocyanine hydroxide (12 mg/Ag mol), was added and the pH of the emulsion adjusted to 6.0. An emulsion thus sensitized also contained a cyan dye-forming coupler 2-(alpha (2,4-di-tert-amyl-phenoxy)butyramido)-4,6-dichloro-5-ethyl phenol (0.42 g/m$^2$) in di-n-butyl phthalate coupler solvent (0.429 g/m$^2$) and gelatin (1 .08g/m$^2$). The emulsion (0.18 g Ag/m$^2$) was coated on a resin coated paper support and 1.076 g/m$^2$ gel overcoat was applied as a protective layer along with the hardener bis (vinylsulfonyl) methyl ether in an amount of 1.8% of the total gelatin weight. These coatings were exposed and processed as for Example 4.

TABLE 2

| | Au | μmol / Ag mol | Hypo | Spd | Dmin | 0.5 Toe | 0.3 Toe | Gamma | Shldr | Dmax |
|---|---|---|---|---|---|---|---|---|---|---|
| 14 (comparison) | none | 0 | N | 87 | 0.094 | 0.160 | 0.362 | 1.356 | 1.657 | 1.846 |
| 15 (comparison) | none | 0 | Y | 81 | 0.107 | 0.229 | 0.462 | 1.313 | 1.418 | 1.883 |
| 16 (comparison) | TTT | 0 | N | 91 | 0.108 | 0.184 | 0.340 | 1.508 | 1.946 | 2.042 |
| 17 (comparison) | TTT | 27 | Y | 148 | 0.097 | 0.163 | 0.348 | 1.878 | 2.550 | 2.650 |
| 18 (comparison) | S | 27 | N | 89 | 0.095 | 0.198 | 0.336 | 1.640 | 2.173 | 2.124 |
| 19 (invention) | S | 5 | Y | 147 | 0.096 | 0.174 | 0.357 | 1.798 | 2.402 | 2.643 |
| 20 (invention) | S | 8 | Y | 151 | 0.102 | 0.176 | 0.365 | 1.865 | 2.500 | 2.596 |
| 21 (invention) | S | 11 | Y | 155 | 0.095 | 0.156 | 0.342 | 1.918 | 2.627 | 2.676 |
| 22 (invention) | S | 14 | Y | 154 | 0.101 | 0.165 | 0.341 | 1.964 | 2.705 | 2.677 |
| 23 (invention) | S | 16 | Y | 152 | 0.102 | 0.169 | 0.356 | 1.882 | 2.542 | 2.575 |
| 24 (invention) | S | 22 | Y | 145 | 0.101 | 0.168 | 0.352 | 1.864 | 2.520 | 2.573 |
| 25 (invention) | S | 27 | Y | 144 | 0.113 | 0.184 | 0.367 | 1.943 | 2.627 | 2.738 |

TABLE 2-continued

| | Au | μmol Ag mol | Hypo | Spd | Dmin | 0.5 Toe | 0.3 Toe | Gamma | Shldr | Dmax |
|---|---|---|---|---|---|---|---|---|---|---|
| 26 (invention) | S | 33 | Y | 140 | 0.102 | 0.184 | 0.365 | 1.883 | 2.529 | 2.667 |
| 27 (invention) | S | 38 | Y | 137 | 0.097 | 0.188 | 0.367 | 1.833 | 2.443 | 2.626 |

Data in Table 2 show that samples (19–27) containing the combination of compound S and hypo show a speed much higher than any of the coatings without hypo (sample 14, 16, 18) or the coating (sample 15) containing only hypo. It can be seen that as the level of compound S increases, an optimum speed is reached with samples 21 and 22. With sample (21), the speed is higher than that of the comparison compound TTT (sample 17). Sample 21 also has the desirable attributes of sharper toes (lower values), higher shoulder and contrast (gamma) than the comparison compound TTT (sample 17).

Example 6

In another practice of the invention, a 0.3 mole cubic negative silver chloride emulsion was similarly sensitized as in Example 2 except that compound P was used as the Au(I) sensitizer.

TABLE 3

| | P μmol Ag mol | Spd | Dmin | 0.5 Toe | 0.3 Toe | Shldr | Gamma | Dmax |
|---|---|---|---|---|---|---|---|---|
| 28 (comparison) | 0 | 62 | 0.095 | 0.462 | 0.741 | 1.254 | 0.855 | 1.745 |
| 29 (invention) | 12 | 125 | 0.098 | 0.215 | 0.420 | 1.736 | 2.193 | 2.614 |
| 30 (invention) | 15 | 140 | 0.096 | 0.178 | 0.341 | 1.715 | 2.290 | 2.637 |
| 31 (invention) | 18 | 144 | 0.095 | 0.164 | 0.333 | 1.920 | 2.645 | 2.712 |
| 32 (invention) | 21 | 149 | 0.090 | 0.166 | 0.338 | 1.883 | 2.575 | 2.646 |
| 33 (invention) | 24 | 143 | 0.093 | 0.146 | 0.286 | 2.009 | 2.873 | 2.701 |
| 34 (invention) | 27 | 142 | 0.097 | 0.147 | 0.287 | 2.047 | 2.933 | 2.664 |
| 35 (invention) | 30 | 140 | 0.097 | 0.145 | 0.281 | 2.081 | 3.001 | 2.692 |

Results of this experiment also indicate that Au(I) sensitizers with carboxy solubilizing groups are also effective in enhancing the sensitivity of AgCl emulsions. Other advantages such as sharper toes and higher shoulder and contrast than the comparison (sample 28) are also seen.

The above examples demonstrate the sensitizing effect of one compound of the present invention with hypo. It is anticipated that other emulsions could be sensitized with compounds of the present invention in the absence of hypo, or in the presence of sulfur sensitizers other than hypo.

The invention has been described in detail with particular reference to certain preferred embodiments thereof, but it will be understood that variations and modifications can be effected within the spirit and scope of the invention.

What is claimed is:

1. A silver halide photographic element comprising a support and a silver halide emulsion layer, the emulsion layer comprising an organomercapto Au(I) complex having the formula $$[(M—SOL)_n—A—S—Au—S—A—(SOL—M)_n]M$$

wherein M is a cationic counterion;

SOL is a solubilizing group:

A is a substituted or unsubstituted divalent organic linking group;

and n is 1 to 4 and wherein the compound is symmetrical.

2. The photographic element of claim 1 wherein A is a substituted or unsubstituted aliphatic, aromatic or heterocyclic group.

3. The photographic element of claim 2 wherein A is a substituted or unsubstituted aliphatic group having 1 to 20 carbon atoms, an aromatic group have from 6 to 20 carbon atoms or a 3 to 15-membered heterocyclic ring with at least one atom selected from nitrogen, oxygen, sulfur, selenium or tellurium.

4. The photographic element of claim 3 wherein A is a substituted or unsubstituted aliphatic group having 1 to 8 carbon atoms, an aromatic group having from 6 to 10 carbon atoms or a 5 to 6-membered heterocyclic ring with at least one atom selected from nitrogen.

5. The photographic element of claim 4 wherein A is a substituted or unsubstituted 5 to 6-membered heterocyclic ring with at least one atom selected from nitrogen.

6. The photographic element of claim 1 wherein M is an alkali metal or ammonium cation.

7. The photographic element of claim 6 wherein M is sodium, cesium or potassium.

8. The photographic element of claim 1 wherein SOL is a sulfato, sulfonato, sulfinato, phosphate, or carboxy group.

9. The photographic element of claim 1 wherein A is a substituted or unsubstituted aliphatic group having 1 to 20 carbon atoms, an aromatic group have from 6 to 20 carbon atoms or a 3 to 15-membered heterocyclic ring with at least one atom selected from nitrogen, oxygen, sulfur, selenium or tellurium; M is an alkali metal or an ammonium cation; and SOL is a sulfato, sulfonato, sulfinato, phosphato, or carboxy group.

10. The photographic element of claim 9 wherein A is a substituted or unsubstituted aliphatic group having 1 to 8 carbon atoms, an aromatic group having from 6 to 10 carbon atoms or a 5 to 6-membered heterocyclic ring with at least one atom selected from nitrogen.

11. The photographic element of claim 1 wherein $A—(SOL—M)_n$ is

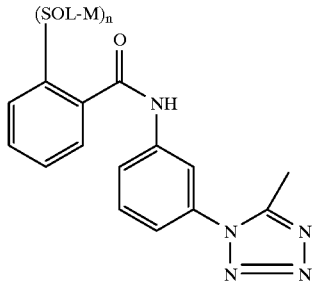

and wherein n is 1.

12. The photographic element of claim 11 wherein M is an alkali metal or an ammonium cation.

13. The photographic element of claim 11 wherein M is sodium, cesium or potassium.

14. The photographic element of claim 11 wherein SOL is a sulfato, sulfonato, sulfinato, phosphate, or carboxy group.

15. The photographic element of claim 1 wherein the silver halide emulsion is greater than 95 mole % silver chloride.

16. The photographic element of claim 1 wherein the amount of the organomercapto Au(I) complex contained in the silver halide emulsion is from 0.1 μmol to 500 μmol per mole of silver.

17. The photographic element of claim 16 wherein the amount of the organomercapto Au(I) complex contained in the silver halide emulsion is from 1 μmol to 50 μmol per mole of silver.

18. A photographic element comprising a support and a silver halide emulsion layer, the emulsion layer comprising a water soluble Au(I) complex having the formula $$[L—Au—L—]M$$

wherein the complex is symmetrical; L is an organomercapto ligand which is an antifogging, stabilizing or sensitizing compound, and M is a cationic counter ion.

19. A silver halide photographic element comprising a support and a silver halide emulsion layer, the emulsion layer having been chemically sensitized in the presence of an Au(I) complex having the formula $$[(M—SOL)_n—A—S—Au—S—A—(SOL—M)_n]M$$

wherein M is a cationic counterion;

SOL is a solubilizing group:

A is a substituted or unsubstituted divalent organic linking group;

and n is 1 to 4 and wherein the compound is symmetrical.

20. The photographic element of claim 1 wherein A is a substituted or unsubstituted aliphatic, aromatic or heterocyclic group.

21. The photographic element of claim 20 wherein A is a substituted or unsubstituted aliphatic group having 1 to 20 carbon atoms, an aromatic group having from 6 to 20 carbon atoms or a 3 to 15-membered heterocyclic ring with at least one atom selected from nitrogen, oxygen, sulfur, selenium or tellurium.

22. The photographic element of claim 21 wherein A is a substituted or unsubstituted aliphatic group having 1 to 8 carbon atoms, an aromatic group having from 6 to 10 carbon atoms or a 5 to 6-membered heterocyclic ring with at least one atom selected from nitrogen.

23. The photographic element of claim 22 wherein A is a substituted or unsubstituted 5 to 6-membered heterocyclic ring with at least one atom selected from nitrogen.

24. The photographic element of claim 19 wherein M is an alkali metal or ammonium cation.

25. The photographic element of claim 24 wherein M is sodium, cesium or potassium.

26. The photographic element of claim 19 wherein SOL is a sulfato, sulfonato, sulfinato, phosphate, or carboxy group.

27. The photographic element of claim 19 wherein A is a substituted or unsubstituted aliphatic group having 1 to 20 carbon atoms, an aromatic group have from 6 to 20 carbon atoms or a 3 to 15-membered heterocyclic ring with at least one atom selected from nitrogen, oxygen, sulfur, selenium or tellurium; M is an alkali metal or an ammonium cation; and SOL is a sulfato, sulfonato, sulfinato, phosphate, or carboxy group.

28. The photographic element of claim 27 wherein A is a substituted or unsubstituted aliphatic group having 1 to 8 carbon atoms, an aromatic group having from 6 to 10 carbon atoms or a 5 to 6-membered heterocyclic ring with at least one atom selected from nitrogen.

29. The photographic element of claim 19 wherein $A—(SOL—M)_n$ is

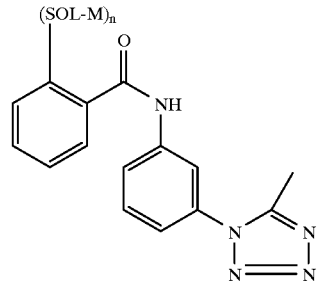

and wherein n is 1.

30. The photographic element of claim 29 wherein M is an alkali metal or an ammonium cation.

31. The photographic element of claim 30 wherein M is sodium, cesium or potassium.

32. The photographic element of claim 19 wherein the emulsion is also sensitized in the presence of hypo.

33. The photographic element of claim 29 wherein SOL is a sulfato, sulfonato, sulfinato, phosphate, or carboxy group.

34. The photographic element of claim 19 wherein the silver halide emulsion is greater than 95 mole % silver chloride.

35. The photographic element of claim 19 wherein the amount of the organomercapto Au(I) complex present during chemical sensitization was from 0.1 μmol to 500 μmol per mole of silver.

36. The photographic element of claim 35 wherein the amount of the organomercapto Au(I) complex present during chemical sensitization was from 1 μmol to 50 μmol per mole of silver.

37. A method of preparing a silver halide emulsion comprising precipitating silver halide grains in an aqueous colloidal medium to form an emulsion, heating the emulsion, and adding to the emulsion, either before or during heating, an organomercapto Au(I) complex having the formula $$[(M—SOL)_n—A—S—Au—S—A—(SOL—M)_n]M$$

wherein M is a cationic counterion;

SOL is a solubilizing group:

A is a substituted or unsubstituted divalent organic linking group;

and n is 1 to 4 and wherein the compound is symmetrical.

38. The method of claim 37 wherein A is a substituted or unsubstituted aliphatic group having 1 to 20 carbon atoms, an aromatic group have from 6 to 20 carbon atoms or a 3 to 15-membered heterocyclic ring with at least one atom selected from nitrogen, oxygen, sulfur, selenium or tellurium; M is an alkali metal or an ammonium cation; and SOL is a sulfato, sulfonato, sulfinato, phosphate, or carboxy group.

39. The method of claim 38 wherein A is a substituted or unsubstituted aliphatic group having 1 to 8 carbon atoms, an aromatic group having from 6 to 10 carbon atoms or a 5 to 6-membered heterocyclic ring with at least one atom selected from nitrogen.

40. The method of claim 37 wherein A—(SOL—M)$_n$ is

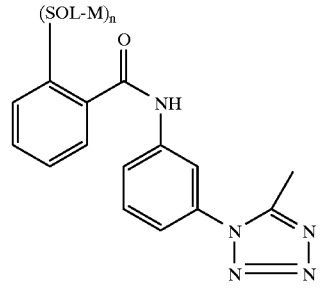

and wherein n is 1.

41. The method of claim 37 wherein the silver halide emulsion is greater than 95 mole % silver chloride.

42. The method of claim 37 wherein the amount of the organomercapto Au(I) complex added to the silver halide emulsion is from 0.1 $\mu$mol to 500 $\mu$mol per mole of silver.

43. The method of claim 37 wherein hypo is added to the emulsion either before or during heating.

* * * * *

UNITED STATES PATENT AND TRADEMARK OFFICE

CERTIFICATE OF CORRECTION

PATENT NO. : 5,945,270
DATED : August 31, 1999
INVENTOR(S) : Roger Lok, et al

It is certified that error appears in the above-identified patent and that said Letters Patent is hereby corrected as shown below:

Column 18, claim 8, line 2
Column 19, claim 14, line 2
Column 20, claim 26, line 2
Column 20, claim 27, line 7
Column 20, claim 33, line 2
Column 21, claim 38, line 7

Signed and Sealed this

Tenth Day of April, 2001

*Attest:*

Nicholas P. Godici

NICHOLAS P. GODICI

*Attesting Officer*

*Acting Director of the United States Patent and Trademark Office*